US009279260B2

(12) United States Patent
Baum

(10) Patent No.: US 9,279,260 B2
(45) Date of Patent: Mar. 8, 2016

(54) MODULAR PANEL CONCRETE FORM FOR SELF-LIFTING CONCRETE FORM SYSTEM

(71) Applicant: Norton Baum, Gilberts, IL (US)

(72) Inventor: Norton Baum, Gilberts, IL (US)

( * ) Notice: Subject to any disclaimer, the term of this patent is extended or adjusted under 35 U.S.C. 154(b) by 0 days.

(21) Appl. No.: 14/052,489

(22) Filed: Oct. 11, 2013

(65) Prior Publication Data

US 2014/0175259 A1 Jun. 26, 2014

Related U.S. Application Data

(60) Provisional application No. 61/713,279, filed on Oct. 12, 2012.

(51) Int. Cl.

| | |
|---|---|
| ***E04G 11/28*** | (2006.01) |
| ***E04G 11/02*** | (2006.01) |
| ***E04G 11/06*** | (2006.01) |
| ***E04G 11/08*** | (2006.01) |

(52) U.S. Cl.

CPC ..... *E04G 11/087* (2013.01); *E04G 11/06* (2013.01); *E04G 11/28* (2013.01); *E04G 11/02* (2013.01)

(58) Field of Classification Search

CPC ..... E04G 11/02; E04G 11/06; E04G 11/087; E04G 11/12; E04G 11/22; E04G 11/28

USPC ..... 249/20, 21, 22; 425/63, 64, 65

See application file for complete search history.

(56) References Cited

U.S. PATENT DOCUMENTS

| | | | | |
|---|---|---|---|---|
| 2,963,763 | A | | 12/1960 | Cluyse |
| 3,246,871 | A | | 4/1966 | Bowden |
| 3,357,673 | A | | 12/1967 | Williams |
| 3,362,674 | A | | 1/1968 | Gilbert |
| 3,362,676 | A | | 1/1968 | Bowden |
| 3,477,684 | A | | 11/1969 | Dagiel |
| 3,486,729 | A | | 12/1969 | Schimmel |
| 3,661,354 | A | | 5/1972 | Cody et al. |
| 4,016,228 | A | * | 4/1977 | Schmidt ..... 264/33 |
| 5,537,797 | A | | 7/1996 | Buck et al. |
| 5,836,126 | A | | 11/1998 | Buck et al. |
| 5,922,236 | A | * | 7/1999 | Zuhl ..... 249/34 |
| 6,148,575 | A | * | 11/2000 | Dingler ..... 52/309.16 |
| 6,260,311 | B1 | | 7/2001 | Vladikovic |
| 8,020,271 | B2 | | 9/2011 | Baum |
| 8,360,389 | B2 | * | 1/2013 | Schwoerer ..... 249/44 |
| 2004/0200168 | A1 | | 10/2004 | Takagi et al. |
| 2009/0146043 | A1 | | 6/2009 | Gates |

* cited by examiner

*Primary Examiner* — Michael Safavi

(74) *Attorney, Agent, or Firm* — Erickson Law Group, PC

(57) ABSTRACT

A modular panelized form wall include a first wall panel and a second wall panel; and a support panel having vertical steel rails which frame the vertical sides of the support panel. The support panel is arranged between the first and second wall panels. The first wall panel, the second wall panel and the support panel are connected together to form a portion of the modular panelized form wall. Wide head brackets can be connected to a top of the support panel for an overhead self-lifting grid system to be attached to the modular panelized form wall. Wide landing brackets can be connected to a bottom of the support panel to transmit the loads from the support panel to the underlying support. Shear pins can be inserted through the vertical steel rails at various locations in the support panel and through corresponding holes in the first and second wall panels, the holes to receive the shear pins to distribute the vertical loads away from the support panel to the first and second wall panels.

16 Claims, 5 Drawing Sheets

MODULAR PANEL CONCRETE FORM FOR SELF-LIFTING CONCRETE FORM SYSTEM

This application claims the benefit of U.S. Provisional Application No. 61/713,279 filed Oct. 12, 2012.

BACKGROUND OF THE INVENTION

Self-lifting concrete forming systems utilize hydraulic cylinders to lift an overhead steel grid from which concrete forms are hung vertically. The hydraulic cylinders lift the grid and forms after each course of concrete is poured and cured. The forms are landed on spaced apart landing brackets that are secured to the previously cured concrete course, to form the next course on top of the previous course. These self-lifting systems are used for example in pouring elevator cores in high rise building construction. The forms used in self-lifting concrete systems are typically built out of wooden beams arranged vertically and steel walers arranged horizontally and plywood sheets. Fabricating these forms requires plywood sheets and walers and beams and the labor to assemble the form panels. The vertical loads from the steel grid and forms are transmitted down through spaced apart vertical steel components that form columns, to the spaced apart landing brackets.

Modular panelized systems have been used in crane lifted applications. However, known panelized systems have heretofore not been suitable for certain self-lifting form systems. For a self-lifting form system using hydraulic jacks, during a landing operation, the weight of the steel grid and the forms need to be transmitted through the forms as concentrated loads to the spaced apart landing brackets below. Also, the concentrated vertical loads encountered when the form is lifted by the steel grid also need to be distributed through the form system. Because of the loads involved in this self-lifting concrete form system, the normal system of assembly of the modular panelized system may not be sufficient to hold the system together during lifting and landing operations. The vertical steel components or columns sufficient for the vertical loads are typically not present on any modular panelized system.

The present inventor has recognized that there is a need for a system that can transmit the vertical loads of a self-lifting concrete forming system directly through a panelized form system. By being able to utilize the panelized form system the material and fabrication costs to the contractor would be reduced. This would also make the use of a self-lifting concrete forming system cost effective for use in forming smaller structures.

SUMMARY

One method provides a modular panelized form that utilizes a support panel of a narrow pre-determined width that brings the vertical steel rails which frame the support panel closer together. These vertical steel rails are sufficient to transmit the vertical loads. These support panels can be located as needed in the design of the modular panelized form and an overhead self-lifting grid system. Wide head brackets can be employed at the top of the support panel for the overhead self-lifting grid system to be attached to the modular panelized form. Also, wide landing brackets can be utilized to transmit the loads from the support panel to the landing bracket. Bearing washers can be utilized at both the top and bottom of the support panel where the intersections are secured to the grid system and the landing bracket. Holes can be positioned in the top and bottom of the support panel to accommodate the connections required at these points. Holes can be placed in the vertical members at various locations in the support panel to facilitate the use of shear pins. These shear pins will distribute the loads away from the support panel to the rest of the system without depending totally on the original panel assembly components.

A modular panelized form wall can include a first wall panel and a second wall panel; and a support panel having vertical steel rails which frame the vertical sides of the support panel. The support panel is arranged between the first and second wall panels. The first wall panel, the second wall panel and the support panel are connected together to form a portion of the modular panelized form wall.

Wide head brackets can be connected to a top of the support panel for an overhead self-lifting grid system to be attached to the modular panelized form wall.

Wide landing brackets can be connected to a bottom of the support panel to transmit the loads from the support panel to the underlying support.

Shear pins can be inserted through the vertical steel rails at various locations in the support panel and through corresponding holes in the first and second wall panels, the holes to receive the shear pins to distribute the vertical loads away from the support panel to the first and second wall panels.

The support panel can have a width of about 1 foot.

A modular forming system can include a plurality of first wall panels that are arranged to be connected together side-by-side to form a first forming wall, wherein the first forming wall can be supported along its length by hanging at first support locations from an overhead support. The first wall panels include first support panels and said first support locations are located on the first support panels. Each first support panel includes vertical rails connected together at a top of the support panel by a head bracket and the head bracket provides the connection for hanging from the overhead support.

The first support panels can be spaced apart within the first forming wall and are connected by shear pins to the adjacent wall panels. At least some of the first support panels also each include a landing bracket connecting a bottom of the vertical rails and providing a support for the first wall from an underlying support.

The system can include a second forming wall, said second forming wall supported from the overhead support and relatively movable toward and away from the first forming wall. The space between the first and second forming walls defines a wall to be filled with concrete. The second forming wall can be of the same modular construction as the first forming wall.

The overhead support can comprise a frame and a plurality of jacks connected to the frame at an upper end and to an underlying support at a lower end and arranged to elevate the frame to pour a new wall course on top of a lower course.

The exemplary embodiment apparatus of the invention includes two modular panel forming walls that are positioned at a distance from each other to define a thickness of a wall, to be filled or poured with concrete. At least one of the walls can be supported by the overhead self-lifting grid system such that the wall can be translated toward or away from the respective other wall for forming and stripping the forming walls from the cured concrete.

Numerous other advantages and features of the present invention will become readily apparent from the following detailed description of the invention and the embodiments thereof, and from the accompanying drawings.

DETAILED DESCRIPTION

Figure 1:
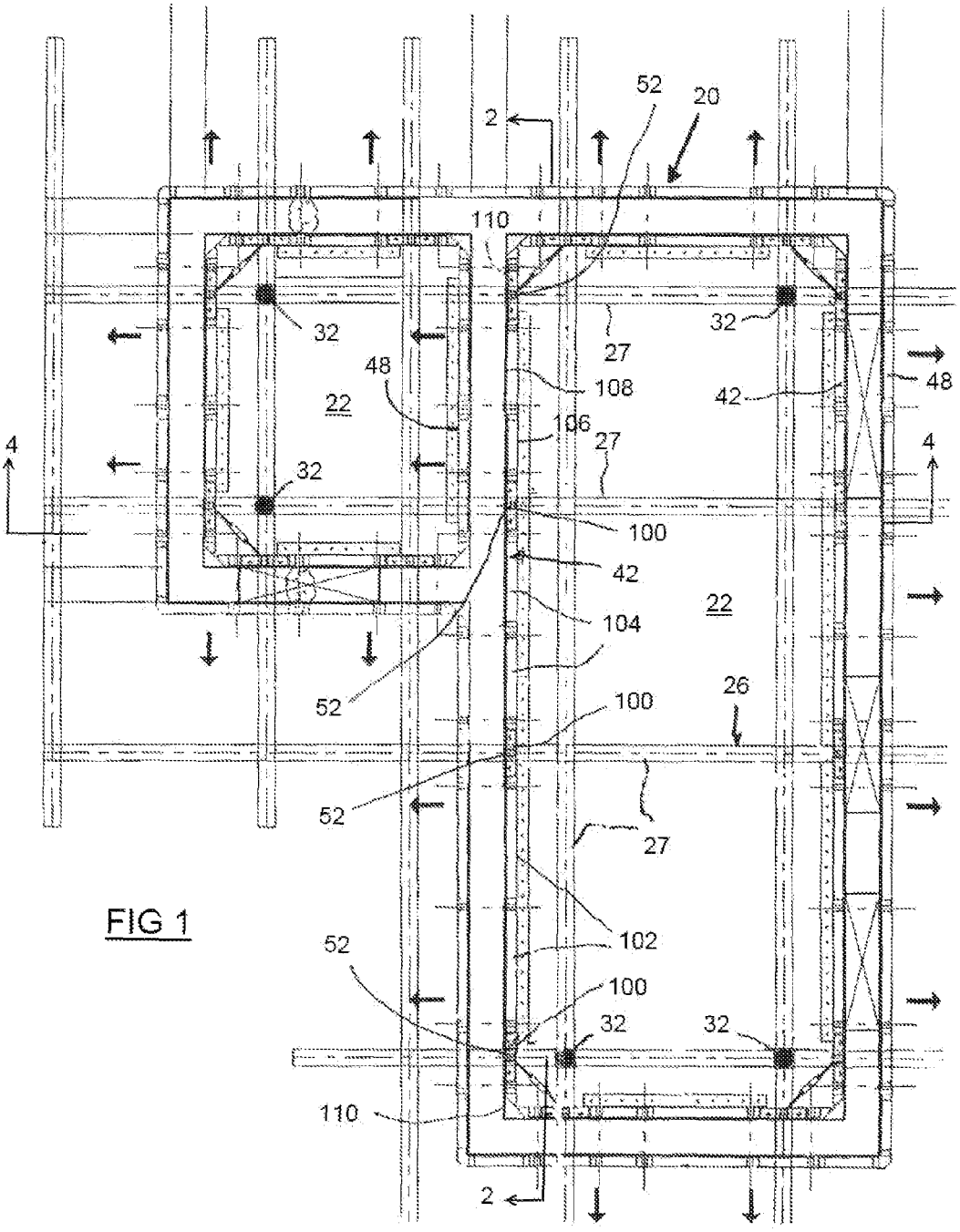
FIG. 1 is a plan view of a forming system incorporating the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a plan view of a self-raising concrete form system 20 that is particularly useful in forming an elevator core 22 and/or a stair core (not shown) in high-rise buildings but can also be useful in other concrete forming operations.

Figure 4:
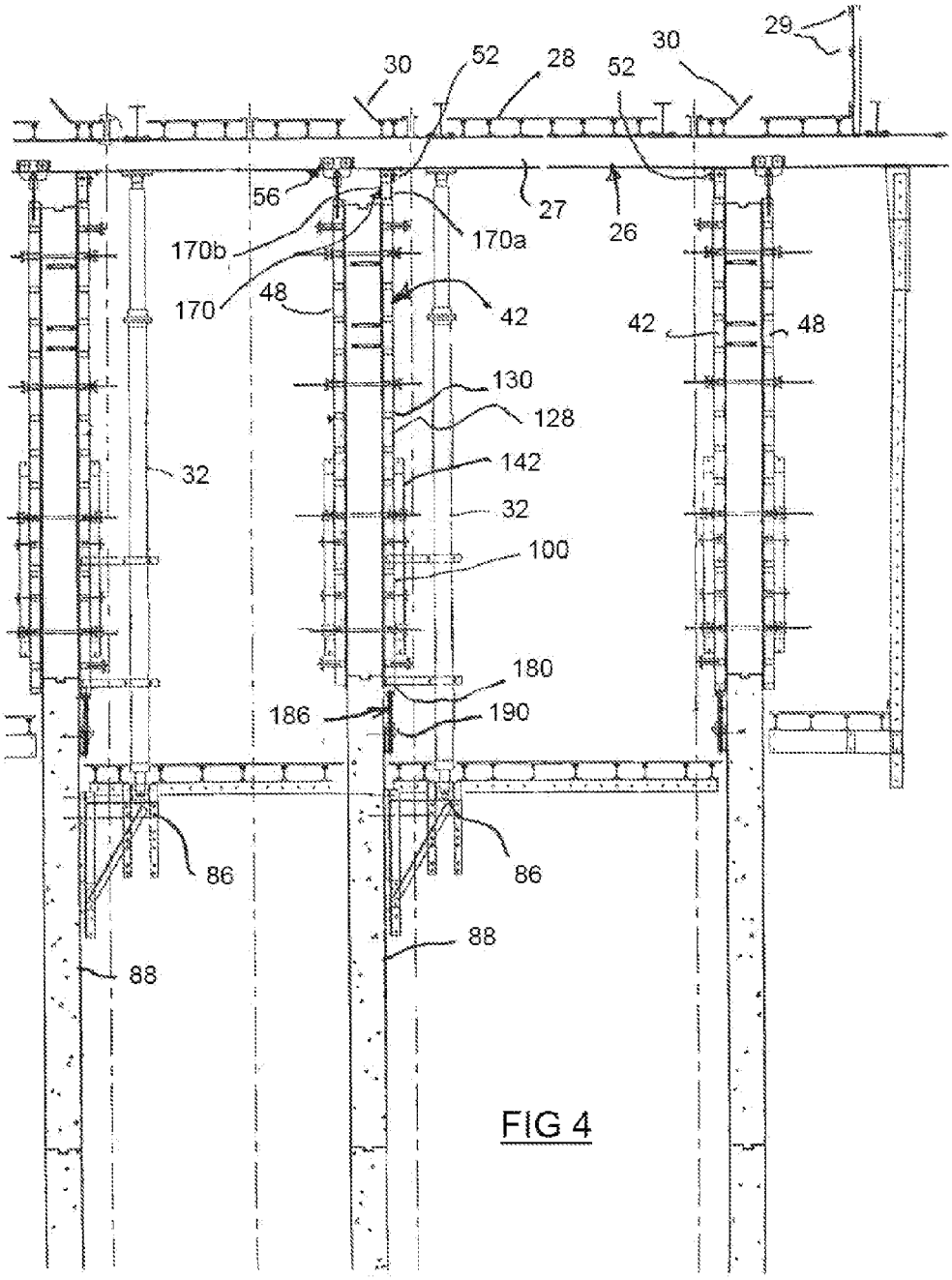
FIG. 4 is a sectional view taken generally along line 4-4 of FIG. 1.

As shown in FIGS. 1 and 4, the system includes a frame 26 that has beams 27 supported by a plurality of hydraulic jacks 32. The frame 26 includes an upper platform deck 28 and appropriate railings 29. A cover 30 can be lifted or pivoted giving access through the platform 28 to the work below.

A first forming wall 42 is fixedly hung from the beams 27 at connections 52. A second forming wall 48 is hung from the beams 27 using rolling connections 56. The second wall 48 can be rolled toward and away from the first wall 42.

The jacks 32 are supported by brackets 86 that are fastened to a previously poured course or level or vertical section 88.

Figure 2:
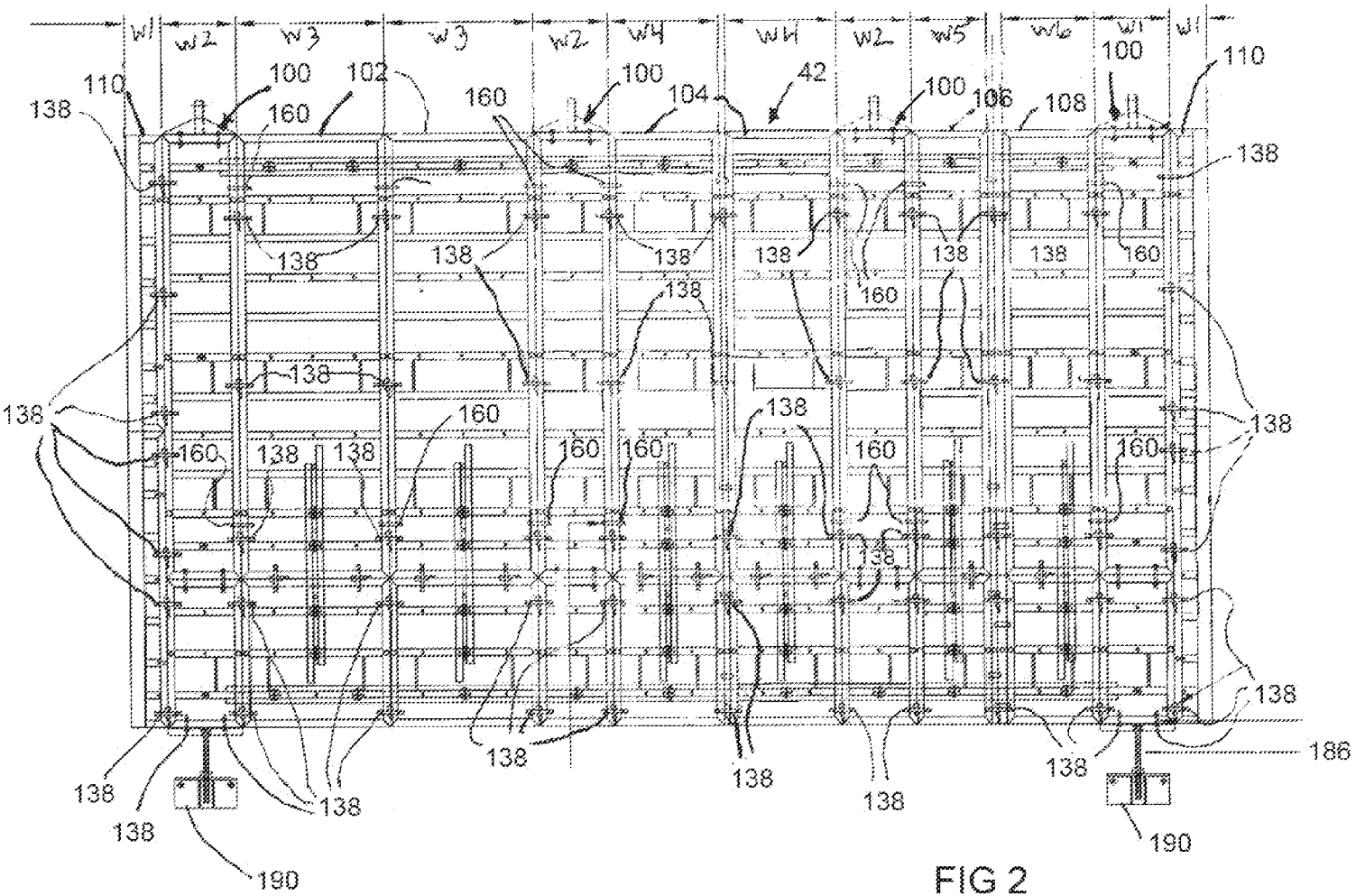
FIG. 2 is a sectional view taken generally along line 2-2 of FIG. 1.

FIG. 2 illustrates the wall 42 in more detail. The wall is composed of modular panels that can be assembled together to assemble a forming wall of desired width. The illustrated wall 42 includes four support panels 100. The wall includes further panels 102, 104, 106, 108 of various widths. According to the exemplary embodiment, the width W1 of corner panel 110 is 1 foot, the width W2 of support panel 100 is 2 feet, the width W3 of panel 102 is 4 feet, the width W4 of panel 104 is 3 feet, the width W5 of panel 106 is 2 feet and the width W6 of panel 108 is 2.5 feet. Stripping corners 110 are arranged at each end of the wall 42.

Figure 3:
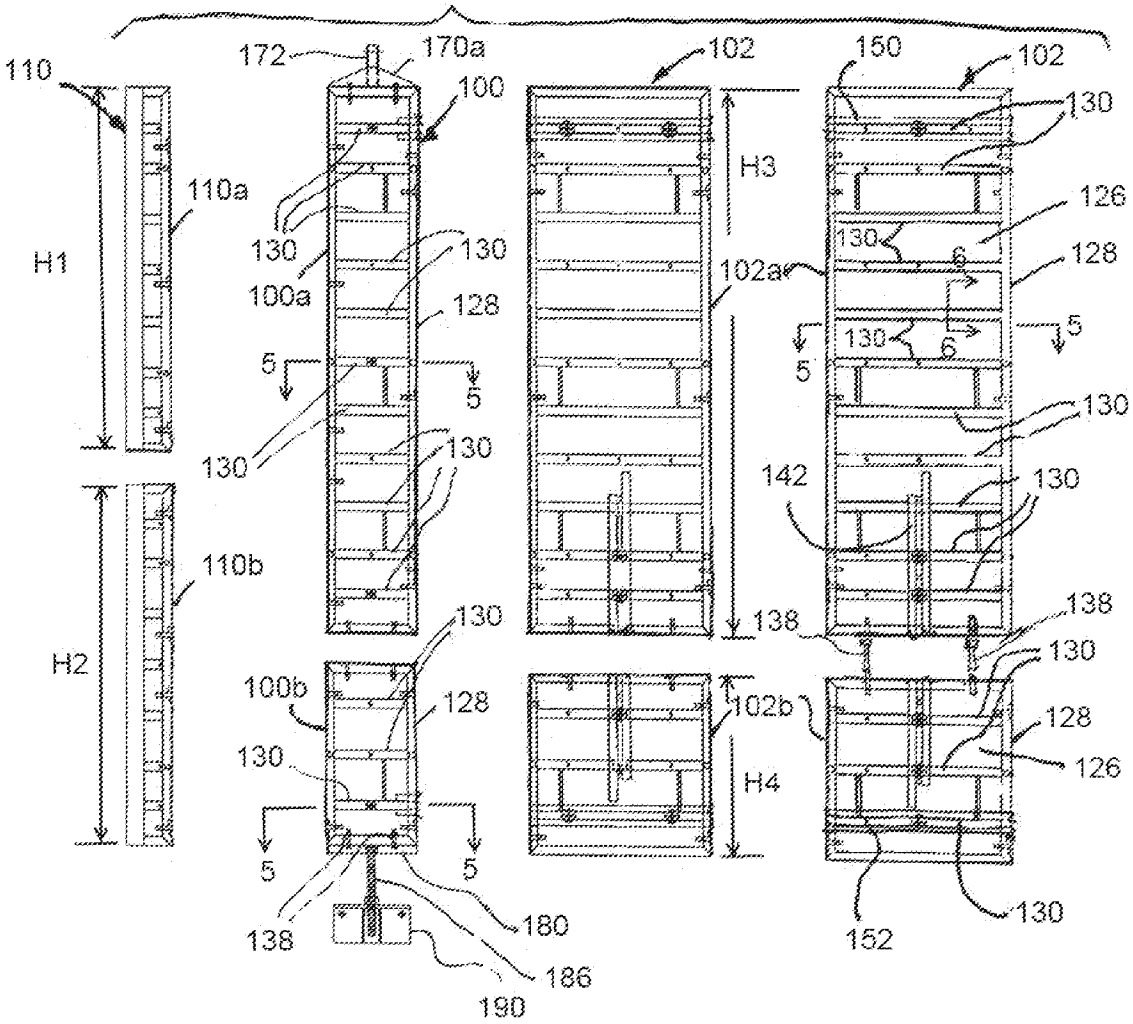
FIG. 3 is a fragmentary, exploded elevation view taken from FIG. 2.

FIG. 3 illustrates that for the wall 42 shown in FIG. 2, each panel 100, 102, 110 comprises a respective upper panel portion 100*a*, 102*a*, 110*a* and a respective lower panel portion 100*b*, 102*b*, 110*b*. The panel heights can respectively be H1 about 8 feet, H2 about 8 feet, H3 about 12 feet and H4 about 4 feet. Each panel 100, 102, 110 comprises a face sheet 126 for forming the cavity for the poured concrete and a surrounding frame 128. The panels 104, 106, 108 are not shown in FIG. 3 but they are identical to the panels 102 except for having varying widths.

Figure 5:
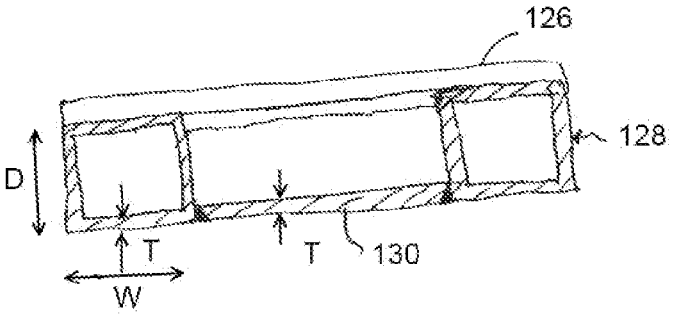
FIG. 5 is a sectional view taken generally along line 5-5 of FIG. 3.
Figure 6:
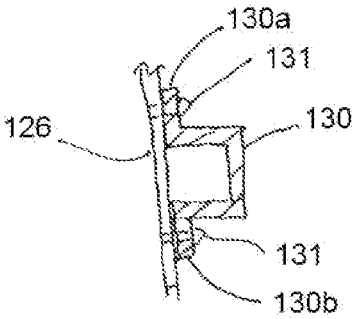
FIG. 6 is a sectional view taken generally along line 6-6 of FIG. 3.

The face sheet can be plywood. The frame 128 is rectangular and is advantageously formed of steel for rigidity. The frame can be formed by welding together steel square tube stock. Advantageously the square tube stock has a width W of about 2⅜ inches, a depth of about 4 inches and a thickness T of about ⅛-¼ inches as shown in FIG. 5. Each panel comprises a plurality of spaced apart horizontal beams 130 that connect on each end to the surrounding frame 128. The horizontal beams 130 can also be formed of steel and are "hat shaped" in cross section as shown in FIG. 6. The steel thickness is substantially the same as the square tube stock of the frame 128. The beams 130 can be welded rigidly at both ends to the frame 128. The beams 130 provide flanges 130*a*, 130*b* for receiving fasteners 131 for mounting the face sheet 126 to the frame 128.

The respective upper and lower panel portions 100*a*, 100*b*; 102*a*, 102*b*; and 110*a*, 110*b* are connected together by clamps or fasteners 138 and at least in the case of upper and lower panels 102*a*, 102*b* by vertical braces 142. The panels 104, 106, 108 are not shown in FIG. 3 but they are identical to the panels 102 except for having varying widths.

As shown in FIG. 2, adjacent panels 100, 102, 104, 106, 108, 110 are connected side-by-side by clamps or fasteners 138 and at least in the case of panels 100, 102, 104, 106, 108, upper and lower horizontal braces 150, 152. As shown in FIG. 2, the panels 100, 102, the panels 100, 104, the panels 102, 102 and the panels 100, 106 and the panels 100, 108 are connected together on common sides by clamps or fasteners 138 and shear pins 160. The panels 104, 104 and the panels 106, 108 are connected by clamps or fasteners 138.

The support panel 100 is configured to replace a separate column support for lifting the wall 42 or for vertically supporting the wall 42. The frame 128 for the support panel is set relatively narrow in width.

Figure 7:
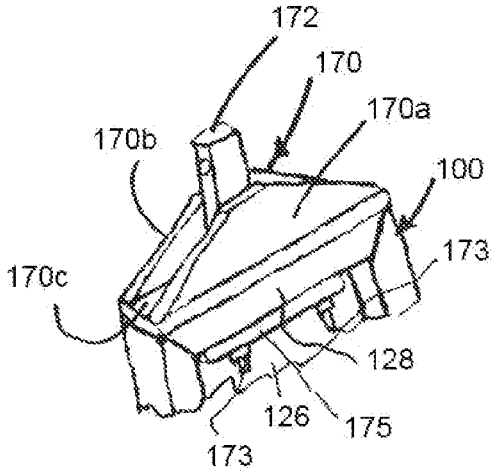
FIG. 7 is a fragmentary perspective view of a top portion of the frame of a support panel.

As shown in FIGS. 4 and 7, the frame 128 of the support panel 100 is connected by a bracket 170 to the overhead beam 27. The bracket includes triangular plates 170*a*, 170*b* welded upstanding to a base plate 170*c* and welded to an upstanding attachment lug 172 between the plates 170*a*, 170*b*. The attachment lug 172 has a hole for attachment to the overhead beam 27 as shown in FIG. 4. The base plate 170*c* is fastened to a top member of the frame 128 by bolt/nut combinations 173 and a rectangular washer plate 175.

At a bottom end, the support panel 100 for the wall 42 can be fastened to a solid bar 180 by clamps or fasteners 138. A threaded rod 186 is threaded into the bar 180 at one end and connected by two nuts 182*a*, 182*b* to a landing bracket 190 having an L-shaped cross section at an opposite end. The landing bracket is secured by fasteners to a previously cured concrete course. The two nuts 182*a*, 182*b* are used to adjust the height of the bar 180 with respect to the bracket 190 to level the form wall 42 on multiple landing brackets 190.

Although the support panels 100 are described above as being part of the first forming wall 42 it is also encompassed by the invention that the support panels could be used in the second forming wall 48 that is hung from the beams 27 using the rolling connections 56.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A modular forming system, comprising:

a plurality of support panels and further wall panels that are arranged to be connected together side-by-side to form a first forming wall, wherein the first forming wall can be supported along its length by hanging at first support locations from an overhead support, wherein the first support locations are located on the support panels, wherein each support panel includes first vertical rails connected together at a top of the support panel by a head bracket and the head bracket provides the connection for hanging from the overhead support;

wherein the further wall panels have second vertical rails and the spacing of the second vertical rails on each further wall panel adjacent to at least one side of a respective support panel is wider than the spacing of the first vertical rails on the respective support panel.

2. The system according to claim 1, wherein the support panels are spaced apart within the first forming wall and are connected by shear pins to the adjacent further wall panels.

3. The system according to claim 2, wherein at least some of the support panels also each include a landing bracket connecting a bottom of the vertical rails of the respective support panel and providing a support for the first forming wall from an underlying support.

4. The system according to claim 1, further comprising a second forming wall, said second forming wall supported from the overhead support and relatively movable toward and away from the first forming wall, the space between the first and second forming walls defining a wall to be filled with concrete.

5. The system according to claim 4, wherein the overhead support comprises a frame and a plurality of jacks connected to the frame at an upper end and to an underlying support at a lower end and arranged to elevate the frame to pour a new wall course on top of a lower course.

6. The form wall according to claim 1, wherein the support panel has a width of 2 feet.

7. The form wall according to claim 6, wherein the first forming wall is a straight wall.

8. A modular panelized form wall, comprising:

a first wall panel and a second wall panel, each first and second wall panels having vertical steel rails spaced apart at a first distance; and a support panel having vertical steel rails which frame the vertical sides of the support panel spaced apart at a second distance less than the first distance, the support panel arranged between the first and second wall panels, the first wall panel, the second wall panel and the support panel being fastened together to form a portion of the modular panelized form wall;

wherein the portion of the modular panelized form wall is a straight wall portion; and comprising head brackets connected to a top of the support panel for an overhead self-lifting grid system to be attached to the modular panelized form wall.

9. The form wall according to claim 8, wherein landing brackets are connected to a bottom of the support panel to transmit loads from the support panel to an underlying support.

10. The form wall according to claim 8, further comprising shear pins and wherein holes are placed in the vertical steel rails at various locations in the support panel and corresponding holes in the first and second wall panels, the holes to receive the shear pins to transfer vertical loads between the support panel and the first and second wall panels.

11. The modular forming system according to claim 8, wherein each support panel has a width of 2 feet.

12. The modular forming system according to claim 1, wherein the first forming wall is a straight wall.

13. The modular forming system according to claim 12, wherein landing brackets are connected to a bottom of some of the support panels to transmit loads from the support panel to an underlying support.

14. The modular forming system according to claim 12, further comprising shear pins and wherein holes are placed in the vertical steel rails at various locations in the support panel and corresponding holes in the first and second wall panels, the holes to receive the shear pins to distribute vertical loads away from the support panel to the first and second wall panels.

15. The modular forming system according to claim 1, wherein the spacing of the second vertical rails on the further wall panels varies in order to form the first forming wall of a selectable overall width.

16. The system according to claim 1, wherein at least some of the support panels also each include a landing bracket connecting a bottom of the vertical rails of the respective support panel and providing a support for the first forming wall from an underlying support.

* * * * *